US005218165A

United States Patent [19]

Cornelius et al.

[11] Patent Number: 5,218,165

[45] Date of Patent: Jun. 8, 1993

[54] PNEUMATIC SEPARATION DEVICE

[75] Inventors: Charles S. Cornelius, Huntsville, Ala.; David A. Gibson, Fayetteville, Tenn.; Stephen C. Cayson, Harvest, Ala.

[73] Assignee: The United States of America as represented by the Secretary of the Army, Washington, D.C.

[21] Appl. No.: 896,632

[22] Filed: Jun. 10, 1992

[51] Int. Cl.[5] ..... F42B 15/38; B64D 1/06

[52] U.S. Cl. ..... 102/378; 89/1.57

[58] Field of Search ..... 244/172, 58, 137.4; 102/377, 378, 393; 89/1.14, 1.57

[56] References Cited

U.S. PATENT DOCUMENTS

| | | | |
|---|---|---|---|
| 4,089,250 | 5/1978 | Jakubowski et al. | 89/1.57 |
| 4,635,443 | 1/1987 | Pino | 89/1.14 |
| 4,867,357 | 9/1989 | Inglis et al. | 102/377 |
| 4,879,941 | 11/1989 | Repé et al. | 89/378 |
| 4,998,480 | 3/1991 | Denis et al. | 89/1.57 |
| 5,117,758 | 6/1992 | Renzi | 102/378 |

*Primary Examiner*—David H. Brown

*Attorney, Agent, or Firm*—Freddie M. Bush; Hay Kyung Chang

[57] ABSTRACT

Upon the occurrence of a preset event, compressed gas is released from a chamber and travels to fill a bellows. The bellows inflates and provides the power to eject a force transfer strut from the cavity of one body. The strut being fixedly attached at one end to a second body, this ejection accomplishes the separation of the two bodies from each other.

5 Claims, 5 Drawing Sheets

PNEUMATIC SEPARATION DEVICE

DEDICATORY CLAUSE

The invention described herein may be manufactured, used, and licensed by or for the Government for governmental purposes without the payment to us of any royalties thereon.

BACKGROUND OF THE INVENTION

At present, all anti-armor missile systems carry the propulsion units (boost and flight motors) internally, i.e., inside the missile fuselage. When these motors have "burned out", i.e. provided all of their propulsive energy to the missile for acceleration downrange, they become parasitic weight and make no other contribution to the flight of the missile. Externally mounted propulsion units (boosters) which can be jettisoned after the transfer of their energy to the missile allow the remaining missile components to be packaged in a smaller, separate volume, thereby reducing the frontal area of the missile. Upon release of the boosters in a kinetic energy missile application, the drag on the missile that had been caused by the externally mounted boosters is eliminated. This enables the low-drag centerbody of the missile to maintain a high velocity for a much longer period of time than it would otherwise and thereby increase drastically its effectiveness.

SUMMARY OF THE INVENTION

The Pneumatic Separation Device allows the motors to be attached externally to the missile's fuselage from which, having accelerated the missile to a maximum attainable velocity, they can be detached and discarded, thus minimizing the drag on the missile and increasing its effective range. The detachment occurs when the inflated bellows completely ejects the motor thrust transfer strut, which is permanently attached to the booster, from the centerbody cavity where the strut had been inserted.

External attachment of the motors also removes the restriction on the motor size, since the motors no longer have to fit inside the missile fuselage, enabling the utilization of larger, faster and more efficient motors.

DESCRIPTION OF THE PREFERRED EMBODIMENT

Figure 1:
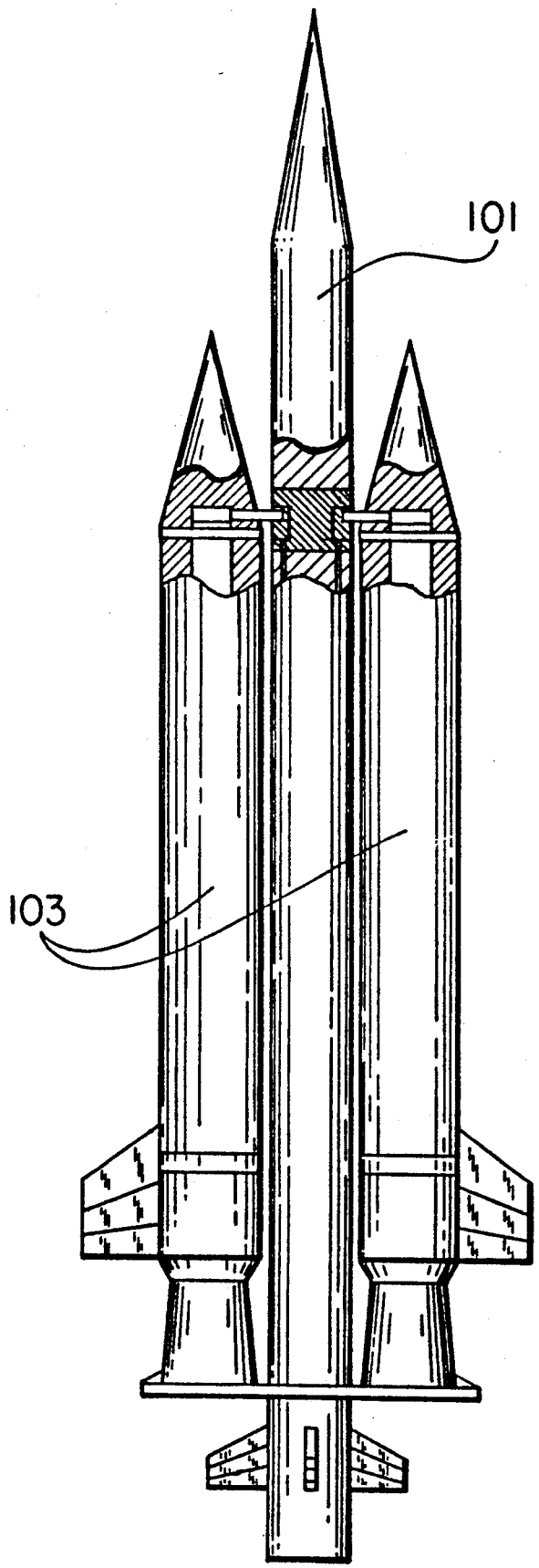
FIG. 1 shows an overview of the missile assembled with the boosters.

Referring now to the Figures wherein like numbers bespeak of like parts, FIG. 1 shows a side view of missile 101 and boosters 103 which are attached to the missile and give it power in takeoff and acceleration in flight.

Figure 2:
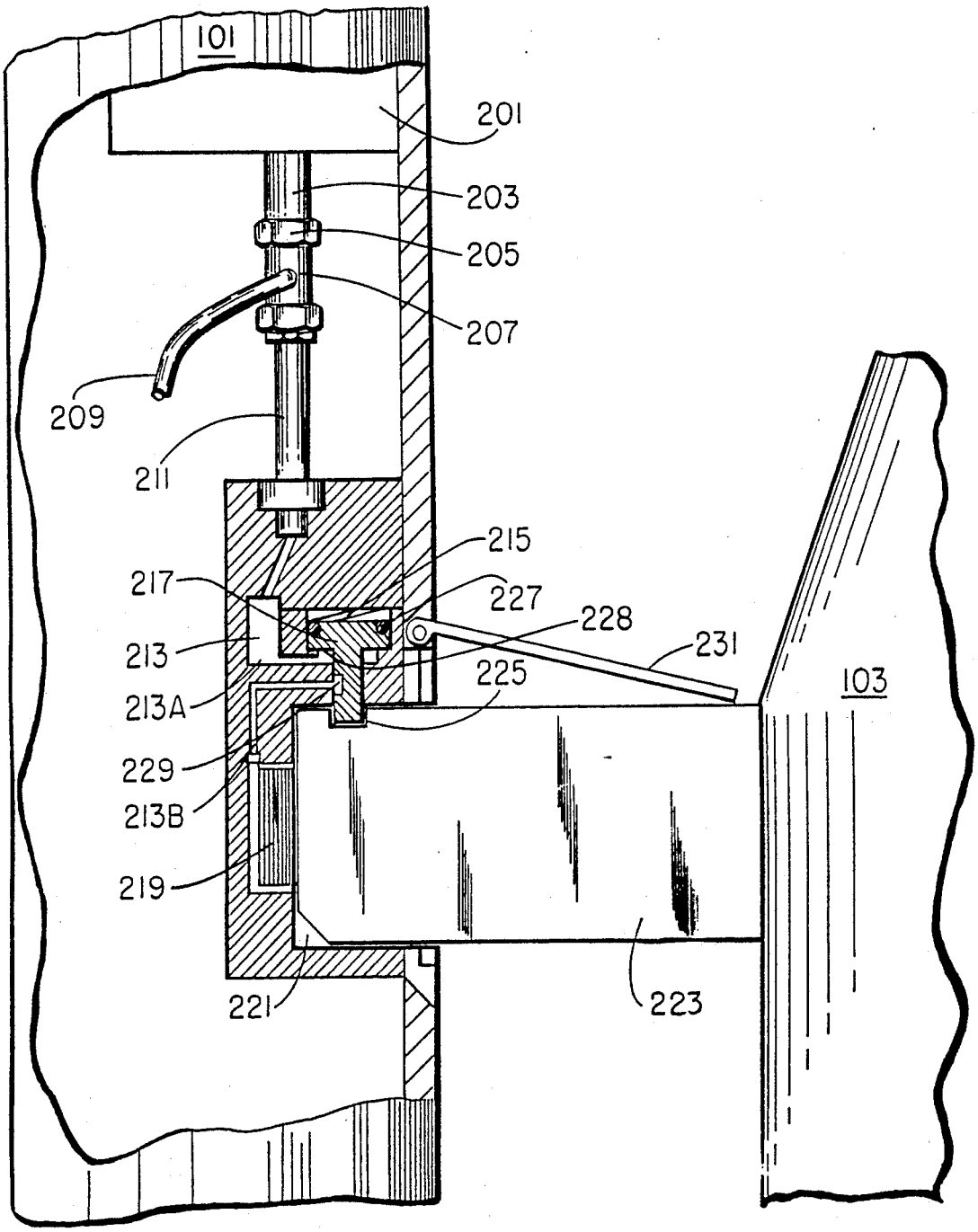
FIG. 2 is a diagram of a preferred embodiment of the Pneumatic Separation Device.

FIG. 2 shows a cut-away diagram of a preferred embodiment of the Pneumatic Separation Device. All of the components of the device are affixed to missile

101 except motor thrust transfer strut 223 which is fixedly attached at one end to booster 103 and is detachably inserted at the other end into cavity 221 at a side of missile 101.

Chamber 201 holds therein high-pressure gas. Exit from the chamber is provided by spout 203 which is initially closed by valve 205. Valve 205 is coupled to pyrotechnic device 207, such as a squib, which is connected via conventional coupling means 209 to an onboard computer, not shown. At a predetermined time which coincides with the missile's maximum velocity, a firing voltage is delivered from the time circuit in the guidance and control portion of the computer via coupling means 209 to pyrotechnic device 207. The pyrotechnic device, in response to the voltage, ignites and opens the sealed valve 205, thereby releasing the high-pressure gas from chamber 201. Escaping through the open valve, the gas travels through gas transfer line 211 which is suitably coupled between the valve and reservoir 213 and enters reservoir 213.

Figure 3:
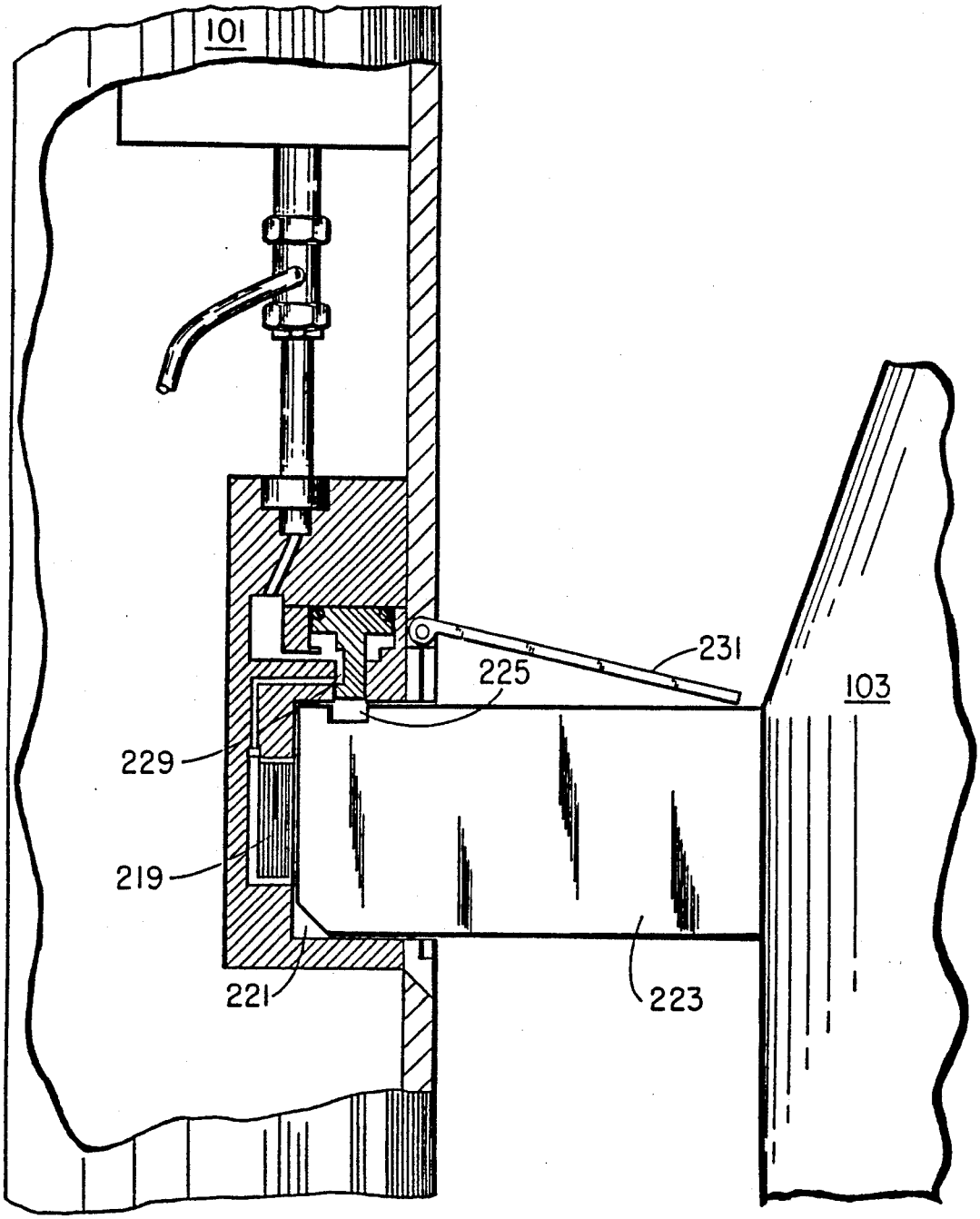
FIG. 3 shows retraction of the piston and an early stage of bellows inflation.
Figure 4:
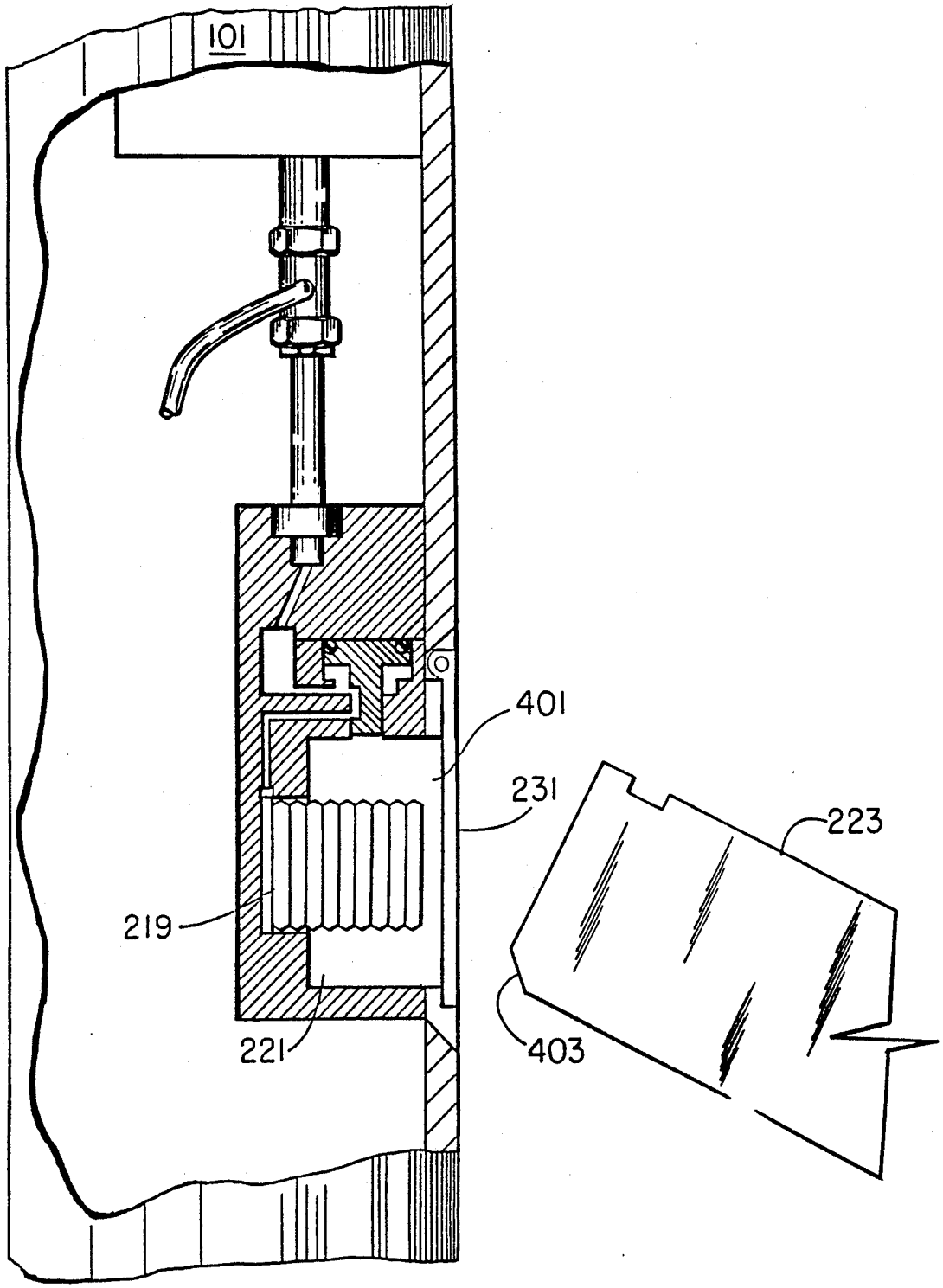
FIG. 4 illustrates a complete ejection of the motor thrust transfer strut from the cavity and closing of the hole in the missile body wall.

Prior to the flight of the missile, motor thrust transfer strut 223 is inserted into cavity 221 to be detachably mounted on top of uninflated bellows 219, and is held in place by retractable piston 217 which is inserted into slot 225 at a side of the strut. Piston 217, in turn, is kept in slot 225 by spring 215 and is sealed by O-ring 227. Reservoir 213 is juxtaposed to piston 217 so that while the piston remains in slot 225, there is no continuous flow path through the reservoir to bellows 219. In essence, piston 217, while it remains in slot 225, divides reservoir 213 into two non-communicating compartments 213A and 213B. However, as gas, that flows through transfer line 211, enters compartment 213A, pressure mounts in the compartment and force is exerted at area 228 tending to dislodge piston 217 from slot 225. As the piston is thusly dislodged, orifice 229, located at a subcaliber section of the piston connects reservoir compartments 213A and 213B to create a continuous flow path to bellows 219. As piston 217 retracts from slot 225 and allows bellows 219 to inflate with the gas, it also frees motor thrust transfer strut 223 which is now no longer constrained in the plane orthogonal to the missile centerline, as shown in FIG. 3. In other words, strut 223 is now free to move in and out. The thrust of booster 103 against the walls of cavity 221 keeps the booster from moving in the orthogonal direction until bellows 219 is fully inflated with the gas. As bellows 219 is filled with gas, it produces a force sufficient to overcome the thrust-induced friction of the strut in the cavity, and moves the strut outwardly causing an angle of attack of the forward end of the booster to the airstream direction, as depicted in FIG. 4. Upon complete removal of strut 223 from cavity 221, a plate 231 covers hole 401 in the missile body wall. Plate 231 may be attached to the missile by any suitable means, such as a hinge mechanism.

A related separation device is disclosed in a co-pending application titled "Manifold Separation Device" Ser. No. 07/896,631, by David A. Gibson and Charles S. Cornelius. This application was filed simultaneously with applicants' application and is assigned to the U.S. Government as represented by the Department of the Army.

Although a particular embodiment and form of this invention has been illustrated, it is apparent that various modifications and embodiments of the invention may be made by those skilled in the art without departing from the scope and spirit of the foregoing disclosure.

Figure 5:
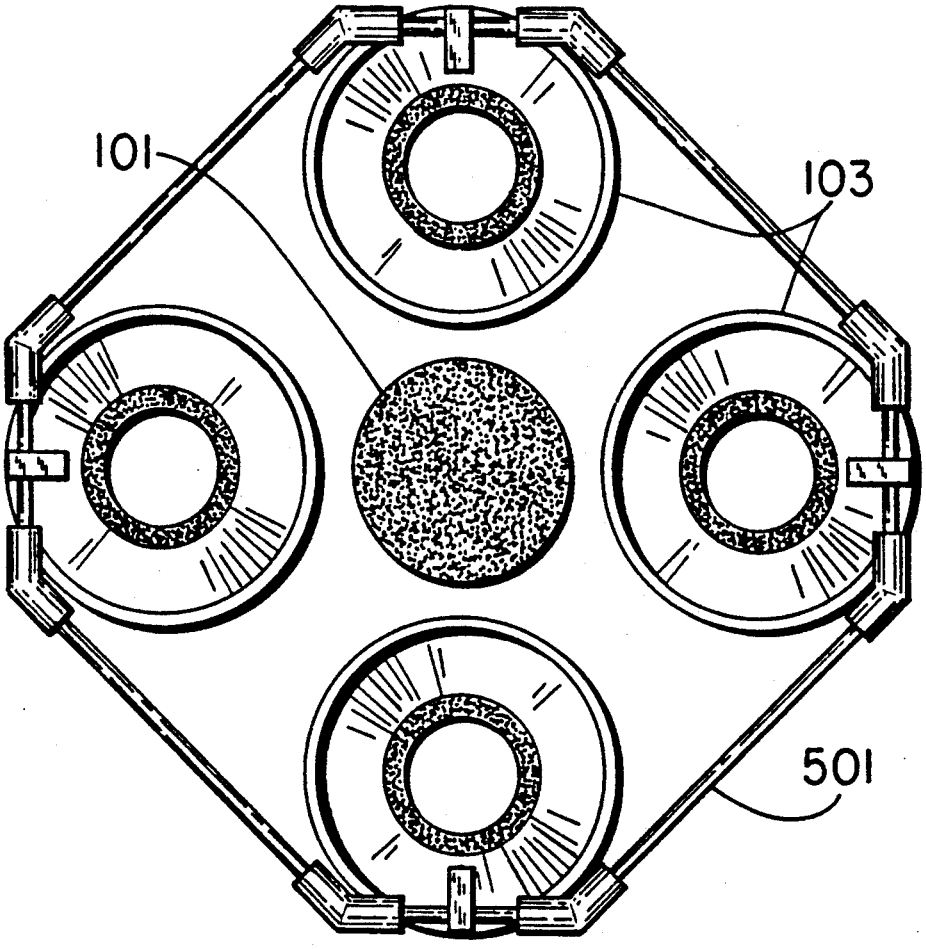
FIG. 5 shows the rotation ring assembly in relation to the missile and the boosters.

One such modification is a rotating ring assembly 501 which is located at the aft of the boosters, as shown in FIG. 5, to help facilitate the separation of boosters 103 from missile 101 by rotating the boosters around the ring assembly after complete ejection of the struts from the cavities. The rotation ring assembly allows the rear of the boosters to pivot so that the nozzles of the boosters do not strike the missile as the missile flies through the ring.

Another modification is shaving corner 403 of strut 223 to give it a slanted shape so that as the strut is ejected from cavity 221 at an angle, the possibility of collision between corner 403 and missile 101 is reduced.

The above-described Pneumatic Separation Device may further be adapted for use in separating any initially joined bodies while moving in any medium.

Accordingly, the scope of the invention should be limited only by the claims appended hereto.

We claim:

1. A method for separating a first body from a second body, said method comprising, opening a valve to allow compressed gas to escape from a chamber;

channeling the gas through a transfer line assembly;

retracting a safety pin to create an unobstructed passage for the gas;

filling a bellows with the gas; and ejecting a thrust transfer strut away from the bellows to effect the separation.

2. A disconnect device for separating a first body from a second body, said device comprising:

a force transfer strut having a first end and a second end, said strut being fixedly attached at said first end to said second body; a means for receiving therein said strut at said second end; a chamber for holding therein a compressed gaseous medium; a bellows, said bellows being juxtaposed to said receiving means and being suitable for inflation with the gaseous medium; a means for providing an unobstructed flow path for the gaseous medium from said chamber to said bellows at the occurrence of a preset event, said receiving means, chamber, bellows and providing means all being suitably affixed to said first body; and a locking means, said locking means being appropriately positioned to hold said strut within said receiving means, said locking means being further adapted for releasing said strut in response to the flow of the gaseous medium from said chamber, thereby freeing said strut and enabling said bellows to inflate with said gas and eject said strut from said receiving means to effect the disconnection of said bodies from each other.

3. A disconnect device as set forth in claim 2, wherein said locking means comprises a depressed slot located on one side of said strut and a retractable piston, said piston being affixed to said first body and suitable for insertion at one end into said slot to hold said strut in said receiving means until a predetermined time.

4. A disconnect device as set forth in claim 3, wherein said providing means comprises a reservoir and a transfer assembly, said reservoir responding to the retracting motion of said piston to provide a flow path for the gaseous medium to said bellows and said assembly being coupled between said chamber and said reservoir to permit flow of the gaseous medium from said chamber to said reservoir at the occurrence of a preset event.

5. A disconnect device as set forth in claim 4, wherein said device further comprises a means for covering said receiving means upon the complete separation of said strut from said first body.

* * * * *